United States Patent [19]

Fischer

[11] 4,169,332

[45] Oct. 2, 1979

[54] CRANK ASSEMBLY

[76] Inventor: Artur Fischer, Weinhalde 34, D-7244 Waldachtal 3 (Tumlingen), Fed. Rep. of Germany

[21] Appl. No.: 826,461

[22] Filed: Aug. 22, 1977

[30] Foreign Application Priority Data

Aug. 21, 1976 [DE] Fed. Rep. of Germany ... 7626280[U]

[51] Int. Cl.[2] ..... A63H 33/06

[52] U.S. Cl. ..... 46/17; 46/23

[58] Field of Search ..... 46/27, 28, 29, 26, 25, 46/24, 16, 17, 39, 23

[56] References Cited

U.S. PATENT DOCUMENTS

| | | | |
|---|---|---|---|
| 2,291,975 | 8/1942 | Minero | 46/23 UX |
| 3,513,587 | 5/1970 | Fischer | 46/16 |
| 3,659,376 | 5/1972 | Fischer | 46/31 |
| 3,747,261 | 7/1973 | Salem | 46/26 |

*Primary Examiner*—Louis G. Mancene
*Assistant Examiner*—Mickey Yu
*Attorney, Agent, or Firm*—Michael J. Striker

[57] ABSTRACT

A crank assembly has an elongated shaft member having two end portions spaced from one another in the direction of an axis of the shaft, one of which portions is provided with a transverse projection. Two structural members are provided adapted to be located at a respective end portion of the crank and to support the same. One of the structural members has an undercut groove and the other structural member has an opening provided with an enlargement in its circumference. The shaft member is insertable into the groove and through the opening so that it can rotate relative to the structural members about the axis of the shaft member. At the same time, the projection of the shaft member is arrestable against undesired rotation by axial displacement of the shaft member relative to the structural members until the projection of the former becomes lodged in the enlargement of the opening of the other structural member, whereby rotation of the shaft member is prevented.

11 Claims, 1 Drawing Figure

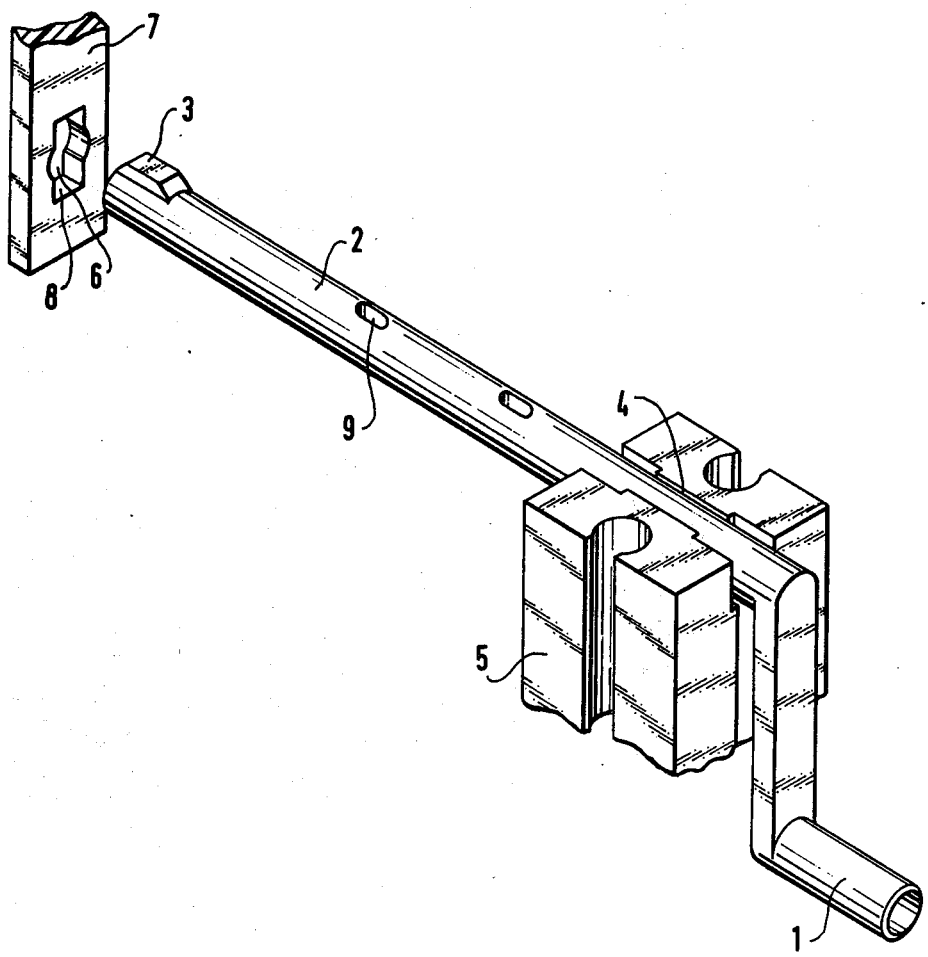
7
3
2
8
6
9
4
5
1

CRANK ASSEMBLY

BACKGROUND OF THE INVENTION

The present invention relates to a crank assembly. More particularly, it relates to a crank which can be used as a structural element of a toy assembly kit.

Cranks for toy assembly kits have been proposed in the art. In order to provide for axial fixation of the crank, spring rings are used which are clamped on a shaft of the crank. Clamping as well as removal of the above spring rings require application of a substantial force which children of underschool age cannot afford, in most cases. Moreover, the known spring rings have small dimensions which further makes difficult for small children to manipulate therewith.

In order to prevent undesired rotation of the crank in opposite direction, pawl arrangements are used which are very expensive to manufacture and occupy a great space.

SUMMARY OF THE INVENTION

Accordingly, it is an object of the present invention to provide a crank assembly which avoids the disadvantages of the prior art.

More particularly, it is an object of the present invention to provide a crank assembly, particularly for a toy assembly kit, which is of a simpler construction, easier to manufacture and easier to play with than the known crank assemblies.

Another object of the present invention is to provide crank assembly which assure an axial fixation of the crank in a very simple way, on the one hand, and prevent an undesired rotation of the crank by simple, cheap and compact means.

In keeping with these objects and with others which will become apparent hereinafter, one feature of the present invention resides, briefly stated, in a crank assembly which has a shaft member provided with a transverse projection on one end portion thereof, and two structural elements having an opening with an enlargement in its circumference, and an undercut groove, respectively. The shaft member is insertable into the groove and through the opening so that it can rotate relative to the structural elements, on the one hand, and the projection of the shaft member can be inserted, by axial displacement of the shaft, into the enlargement of the opening whereby the shaft member can be arrested against undesired rotation about its axis.

The above construction of the crank is extremely simple and operates in a very simple way. The structural members which are provided with the opening and the undercut groove, respectively, are adapted to support the respective end portions of the shaft member and serve as a support for the latter. The shaft member can be inserted into the undercut groove of one of the structural elements and through the opening of the other structural element, and after this when the shaft member is slightly turned about its axis it engages the opposite side of the other structural element so that the axial displacement of the shaft member is prevented. In order to prevent undesired rotation of the crank, for example under the action of a load connected to the crank by a rope, the projection of the shaft member can be inserted in the enlargement of the opening of the one structural element so that the projection abuts against a wall bounding the enlargement and the shaft cannot rotate about its axis.

Both fixation of the shaft member against axial displacement and securing of the same against undesired rotation is performed in a very simple way which does not require application of a great force by or a great experience of small children. Therefore, children of underschool age can easily play with the crank assembly. No additional means are required for performing the above operations.

Another feature of the present invention is that the shaft member of the crank may be constituted of a synthetic plastic material, and the projection of the shaft member may be made of one piece with the shaft member. In this case, the crank is of an especially simple construction, and cheap and easy to manufacture.

A further feature of the present invention is that the opening of the other structural element has a second such enlargement which is located opposite to the first-mentioned enlargement. Preferably, the enlargements of the opening are located diametrically opposite relative to an axis of the opening.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a perspective view of a crank assembly in accordance with the present invention, showing a shaft member of the crank and two structural elements for supporting the shaft member.

DESCRIPTION OF A PREFERRED EMBODIMENT

As shown in the single FIGURE of the drawing, a crank assembly in accordance with the present invention includes a shaft member. The shaft member has an elongated shaft 2 having two end portions, which are spaced from one another in the direction of elongation of the shaft. One of the end portions of the shaft member 2 is provided with a handle 1, whereas the other end portion is provided with a projection 3. The projection 3 extends in a direction transverse to the direction of elongation of the shaft member or to an axis of the latter. The projection 3 extends preferably in a radial direction of the shaft 2. It is advantageous when the projection is made of one piece with the shaft 2, and the shaft member together with the projection 3 and the handle 1 is an integral member constituted of a synthetic plastic material. The shaft 2 has through bores 9 for connecting a cord to the same.

Two structural elements 5 and 7 are further provided, each adapted to be located at a respective end portion of the shaft 2. One of the structural elements 5 may be made as a massive block, whereas the other element 7 may be made as an elongated post. The structural element 5 is provided with an undercut groove 4, and the structural element 7 is provided with a through-going opening 6 having two slot-like enlargements 8. The enlargements 8 extend in mutually opposite directions, preferably in radial directions which are diametrically opposite relative to an axis of the opening 6. The undercut groove 4 of the structural element 5 and the opening 6 of the structural element 7 are so dimensioned as to permit insertion of the shaft 2 therethrough. Each of the enlargements 8 is so dimensioned as to permit insertion of the projection 3 of the shaft 2 into the respective enlargement.

The crank assembly in accordance with the present invention operates in the following manner.

The shaft member is inserted through the undercut groove 4 of the structural element 5 and the opening 6 of the structural element 7 and can be rotated about its axis. When the shaft 2 is slightly turned about its axis, the projection 3 abuts against a side surface of the structural element 7 which is opposite to that of facing towards the structural element 5, and thereby axial displacement of the shaft member 2 is prevented. When the shaft 2 is axially displaced so that the projection 3 thereof is lodged in the enlargement 8 of the opening 6 of the structural element 7, the projection 3 abuts against a wall bounding the enlargement 8, and thereby the shaft 2 is arrested against rotation about its axis.

It will be understood that each of the elements described above, or two or more together, may also find a useful application in other types of constructions differing from the types described above.

While the invention has been illustrated and described as embodied in a crank-assembly, it is not intended to be limited to the details shown, since various modifications and structural changes may be made without departing in any way from the spirit of the present invention.

Without further anyalysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent of the U.S. is set forth in the appended claims:

1. A toy assembly kit for assembling a crank unit, comprising a first supporting structural member having an undercut groove which includes a wider section and a narrower section; a second supporting structural member adapted to be spaced from said first structural member in a first direction and having an opening which is provided with a transverse enlargement in its periphery extending in a direction transverse to said first direction; and a rotatable crank element including an elongated rotatable shaft member having an axis extending in said first direction and two axially spaced ends, said shaft member being insertable into said groove and said opening of said structural members to be supported by the latter, by movement in said first direction so that one of said ends first passes through said undercut groove of said first structural member and thereafter passes through said opening of said second structural member, said rotatable crank element further having a handle provided at the other end of said shaft member to rotate the latter, and only one projection provided at said one end of said shaft member so that when said one end first passes through said undercut groove of said first structural member said projection passes through said narrower section of said undercut groove, and when thereafter said one end of said shaft member passes through said opening of said second structural member said projection passes through said enlargement of said opening, said shaft member being movable between a first position in which said projection extends axially outwardly beyond said second structural member and is circumferentially offset from said enlargement of said opening so that said projection can abut against said second structural member from outside whereby said shaft member can rotate about said axis but cannot be inwardly axially displaced, and a second position in which said projection is lodged in said enlargement of said opening of said second structural member whereby said shaft member becomes arrested against undesired rotation about said axis.

2. The combination as defined in claim 1, wherein said enlargement of said second structural member has a contour corresponding to the contour of said projection of said shaft member.

3. The combination as defined in claim 1, wherein said projection is of one piece with said shaft member.

4. The combination as defined in claim 1, wherein said shaft member is constituted of a synthetic plastic material.

5. The combination as defined in claim 1, wherein said projection extends in a radial direction relative to said shaft member.

6. The combination as defined in claim 1, wherein said enlargement of said opening of said second structural member is slot-like.

7. A combination as defined in claim 1, wherein said first structural member has an end face and said narrower section of said undercut groove is open at said end face so that, when said one end of said shaft member is moved in said direction to pass through said undercut groove, at least a portion of said projection of said shaft member passes outwardly beyond said undercut groove.

8. A combination as defined in claim 1, wherein said supporting structural members are stationary so as to support said crank element for rotation in inserted condition of said shaft member, and are immovable relative to one another.

9. The combination as defined in claim 1, wherein said opening of said other structural member has an axis, said enlargement of said opening extending in a direction transverse to said axial direction.

10. The combination as defined in claim 9, wherein said opening of said second structural member has a further such enlargement extending in a further transverse direction opposite to said first-mentioned transverse direction.

11. The combination as defined in claim 10, wherein said enlargements extend in diametrically opposite transverse directions relative to said axis of said opening.

* * * * *